United States Patent [19]

Ruff

[11] Patent Number: 4,674,128

[45] Date of Patent: Jun. 16, 1987

[54] CARRYING BAG FOR CONES WITH FROZEN COMESTIBLES

[76] Inventor: Stanley L. Ruff, Arbor Dr., New Rochelle, N.Y. 10804

[21] Appl. No.: 665,728

[22] Filed: Oct. 29, 1984

[51] Int. Cl.[4] ..... B65D 75/24

[52] U.S. Cl. ..... 383/10; 229/87 F; 229/87.5; 229/DIG. 7; 383/38; 383/107; 383/127; 426/119; 426/130

[58] Field of Search ..... 383/10, 38, 105, 107, 383/53, 127; 229/87 F, 87 B, 87.5, DIG. 7, 68 C, 72; 426/110, 119, 130; 206/526, 589, 486, 549, 548, 541, 525, 583, 484; 383/105, 107, 53, 127; 150/112, 147

[56] References Cited

U.S. PATENT DOCUMENTS

| | | | |
|---|---|---|---|
| 1,139,128 | 5/1915 | Lindberg | 383/7 X |
| 1,373,136 | 3/1921 | Kranz | 383/10 X |
| 1,466,420 | 8/1923 | Bunker et al. | 383/10 |
| 1,493,137 | 5/1924 | Williams | 229/DIG. 7 |
| 1,627,583 | 5/1927 | Thum | 229/DIG. 6 |
| 1,649,976 | 11/1927 | Poweranz | 383/10 |
| 1,703,139 | 2/1929 | Falcone et al. | 206/315.1 |
| 1,826,976 | 10/1931 | Wright | 383/10 X |
| 1,934,436 | 11/1933 | Lester | 229/87 F |
| 2,761,613 | 9/1956 | Shiv | 383/42 |
| 2,920,671 | 1/1960 | Siris et al. | 150/112 X |
| 3,008,837 | 11/1961 | Kaplen | 206/484 X |
| 3,428,103 | 2/1969 | Walsh | 206/545 X |
| 3,688,974 | 9/1972 | Gennerich et al. | 383/10 |
| 3,732,661 | 5/1973 | Goldberger et al. | 383/10 X |
| 3,782,622 | 1/1974 | Montgomery | 383/10 |

FOREIGN PATENT DOCUMENTS

| | | | |
|---|---|---|---|
| 2634026 | 2/1978 | Fed. Rep. of Germany | 229/DIG. 7 |

*Primary Examiner*—William Price
*Assistant Examiner*—Bryon Gehman
*Attorney, Agent, or Firm*—Kirschstein, Kirschstein, Ottinger & Israel

[57] ABSTRACT

Comestible cones with frozen edibles deposited thereon are safely and securely held and transported in a carrying bag. The carrying bag contains a handle portion which is positioned above the center of gravity of the cone-filled carrying bag and insures that said filled carrying bag is in stable equilibrium. The bag comprises two substantially planar sheets, one of which is juxtaposed behind and in registration with the other. Said two sheets are joined together along their bottoms, along a portion of their sides, and intermediate their sides along a plurality of spaced zones which taper diagonally downwardly toward one another to thus define a plurality of quasi-conical pockets. The non-joined portions of the sides of said sheets define upper panel segments. The cones are receivable in the pockets of the bag and are securely and safely held therein during transport of said cones from place to place. At least the inner surface of the bag is composed of a material having a slippery surface so the frozen edible will not stick to same.

9 Claims, 7 Drawing Figures

FIG. 4
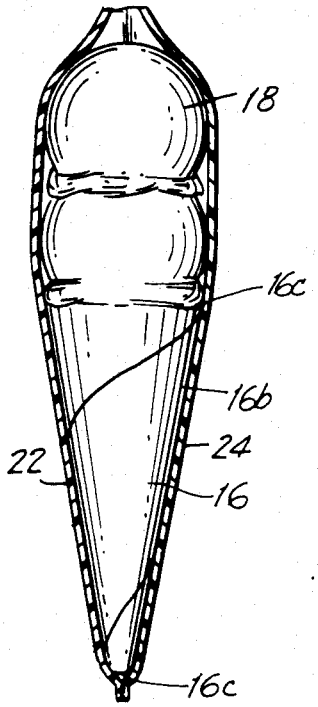
FIG. 5
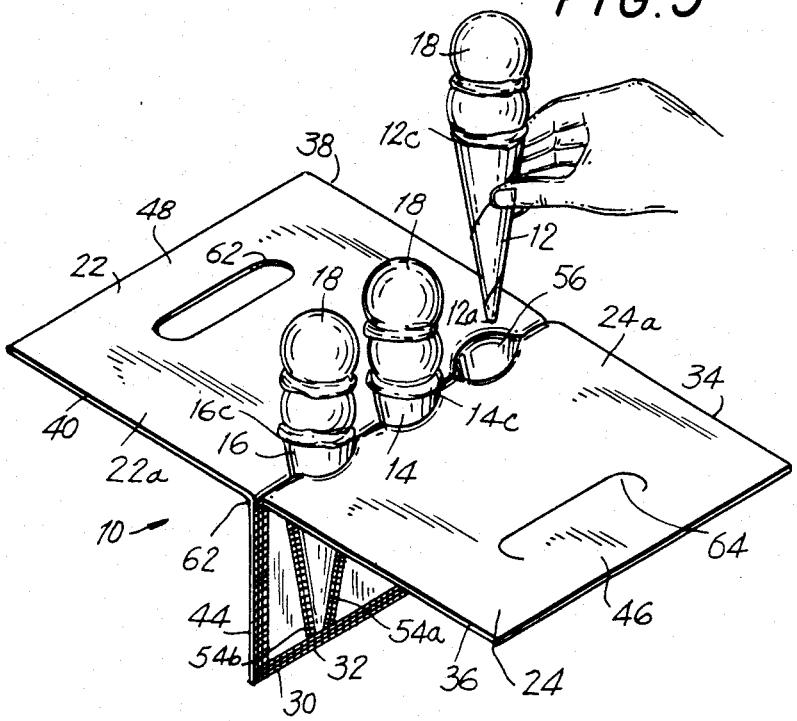
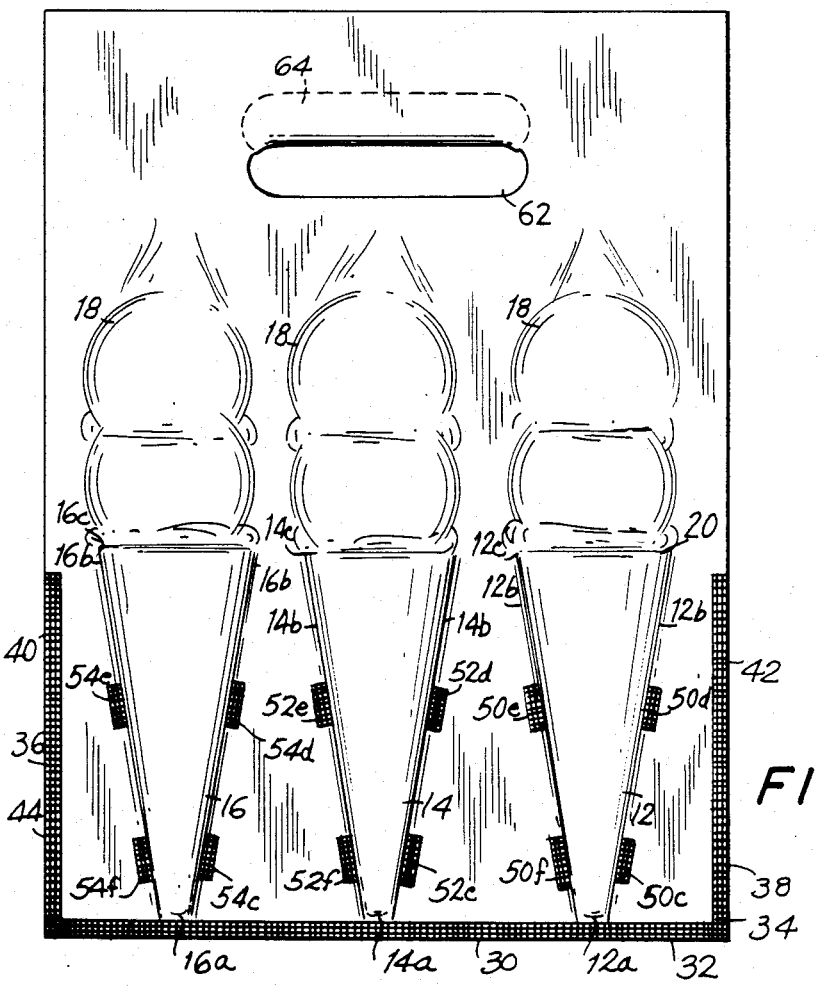
FIG. 6
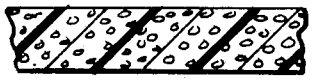
FIG. 7

CARRYING BAG FOR CONES WITH FROZEN COMESTIBLES

BACKGROUND OF THE INVENTION

1. Field of the Invention

A carrying bag for securely holding edible cones having a frozen comestible deposited on the open end thereof.

2. Description of the Prior Art

Frozen comestibles such as soft and hard ice cream and sherbert are often dispensed deposited on the open end of an edible cone. Oftentimes a consumer desires to transport several filled cones away from the place of purchase for distribution and later consumption. When only a single filled cone is so purchased and transported the main problem that occurs relates to keeping the frozen comestible deposited on the cone free of dirt and other foreign matter. However, when more than one filled cone is so purchased and transported, in addition to the problem of keeping the frozen comestible clean, other difficulties arise.

It is difficult for a user to carry more than two filled cones in his hands without an additional carrying means. Since the frozen comestible is not always pushed deeply within the open end of the cone but is more or less perched thereupon, a consumer has to exercise care to prevent the frozen comestible from falling off of a filled cone when transporting same from place to place. Additionally, edible cones with frozen comestibles deposited thereon are generally sold in "fast-food" establishments where the food must be dispensed quickly and where the food sold is relatively inexpensive.

Attempts heretofore have been made to provide a secure method for carrying more than one edible cone with frozen comestibles deposited thereon which does not necessitate a large expenditure of either money or time to use. These attempts have not, however, proven to be completely satisfactory.

One such attempt has been to provide a planar carrying sheet with a plurality of holes therein. The holes were formed to be large enough to permit most of the cone to fit therethrough but small enough to abut against and hold the upper and widest portion of said cone. This carrying arrangement had numerous disadvantages. The frozen comestible deposited on the cone was not protected from dirt; the planar carrying sheet was not very stable and hence the cones held therein wobbled and sometimes tipped over when a person walked with same; it was not always possible to insure that the hole was large enough to prevent breakage of the cone while it was being introduced into said hole; the frozen comestible usually was in contact with the planar sheet and would oftentimes stick to same; and the sheet sometimes bent, permitting the cones to fall out or the frozen comestibles to touch.

Another attempt to provide a carrying arrangement for filled cones was to form a shallow container with two planar surfaces, a bottom planar surface having holes therein of a relatively small diameter to receive the lower ends of the cones and a top planar surface having holes therein of a relatively large diameter to abut against and hold the upper wider portion of said cones. This arrangement also was not problem-free. The frozen edible deposited on the cone still was not protected from dirt and still could come into contact with a planar sheet to which it would oftentimes stick. This arrangement while more stable than the aforementioned arrangement was not very stable and the cones carried in said arrangement still would oftentimes tip and fall while a user walked. Further, to properly fit the cones into and through the two holes took extra time and measurably slowed down the speed at which said cones could be dispensed to customers. Additionally, there existed the possibility of the cones breaking as they were placed into and through said two holes.

SUMMARY OF THE INVENTION

1. Objects of the Invention

It is an object of the present invention to provide an improved carrying bag for holding edible cones having a frozen comestible deposited on the open end thereof.

A further object is to provide a carrying bag which avoids the various drawbacks of prior art carrying equipment.

Another object is to provide a carrying bag of the type described which can hold a plurality of filled cones.

Yet another object is to provide a carrying bag of the type described which will not cause the cones held therein to break.

Still a further object is to provide a carrying bag of the type described which has no parts that can stick to the frozen comestibles deposited on the cones.

Yet another object is to provide a carrying bag which will stably hold filled cones while the same are being transported.

Another object is to provide a carrying bag which protects the frozen comestibles deposited on the cones from dirt.

An additional object is to provide a carrying bag wherein frozen comestibles deposited on edible cones can be dispensed quickly.

Yet a further object is to provide a carrying bag of the type described which remains in stable equilibrium when filled with said cones.

Other objects of the present invention in part will be obvious and in part will be pointed out hereinafter.

2. Brief Description of the Invention

In keeping with these objects and others which will become apparent hereinafter, one feature of the invention resides, briefly stated, in a carrying bag for holding edible cones having a frozen comestible deposited on the open end thereof.

The carrying bag comprises two substantially planar thin flexible sheets. At least the inner surface of each of said two sheets is composed of a material having a slippery surface. Each sheet has a top edge, a bottom edge, and two side edges; said two planar sheets are of substantially the same size and shape. One of said two sheets is juxtaposed directly behind and in registration with the other of said two sheets.

The two planar sheets are joined to one another between the side edges along a plurality of spaced zones which taper diagonally downwardly toward one another to form a plurality of upwardly flaring quasi-conical pockets.

Optionally, the side portions of the two sheets are joined along lines extending upwardly from the bottom edges thereof to points substantially remote from the top edges. The non-joined side portions of said two planar sheets constitute two upper panel segments.

Handle means is included on the carrying bag above the center of gravity of the cone-filled bag to insure that said cone-filled bag is in stable equilibrium.

The cones to be carried in the bag are receivable in the pockets of said carrying bag. The cones when so received in the pockets have their apices pointing downwardly, their conical side walls supported by the slanty surface of the pockets, and their upper ends approximately at the level of the upper end of the joined side portions of the sheets. The frozen comestibles deposited on the cones are above the top of the pairs of zones and may be in loose contact with the slippery inner surfaces of the non-joined panel segments.

Another feature of this invention resides in the provision of a method for securely carrying a plurality of cones with frozen comestibles deposited on the open ends thereof. A plurality of such comestible containing cones may be placed within the pockets of the carrying bag as heretofore described. A user may then hold said carrying bag by the handle means and transport the bag filled with said cones and associated frozen comestibles to wherever desired.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a sectional view taken substantially along line 4—4 of FIG. 1;

FIG. 5 is a perspective view of a carrying bag of the present invention being filled with cones and their associated frozen comestibles;

FIG. 6 is a fragmentary view of an alternative embodiment of the material usable to form a carrying bag of the present invention; and FIG. 7 is a front view of an alternative embodiment of a carrying bag of the present invention filled with cones and associated frozen comestibles.

DETAILED DESCRIPTION OF THE PREFERRED EMBODIMENTS

Figure 1:
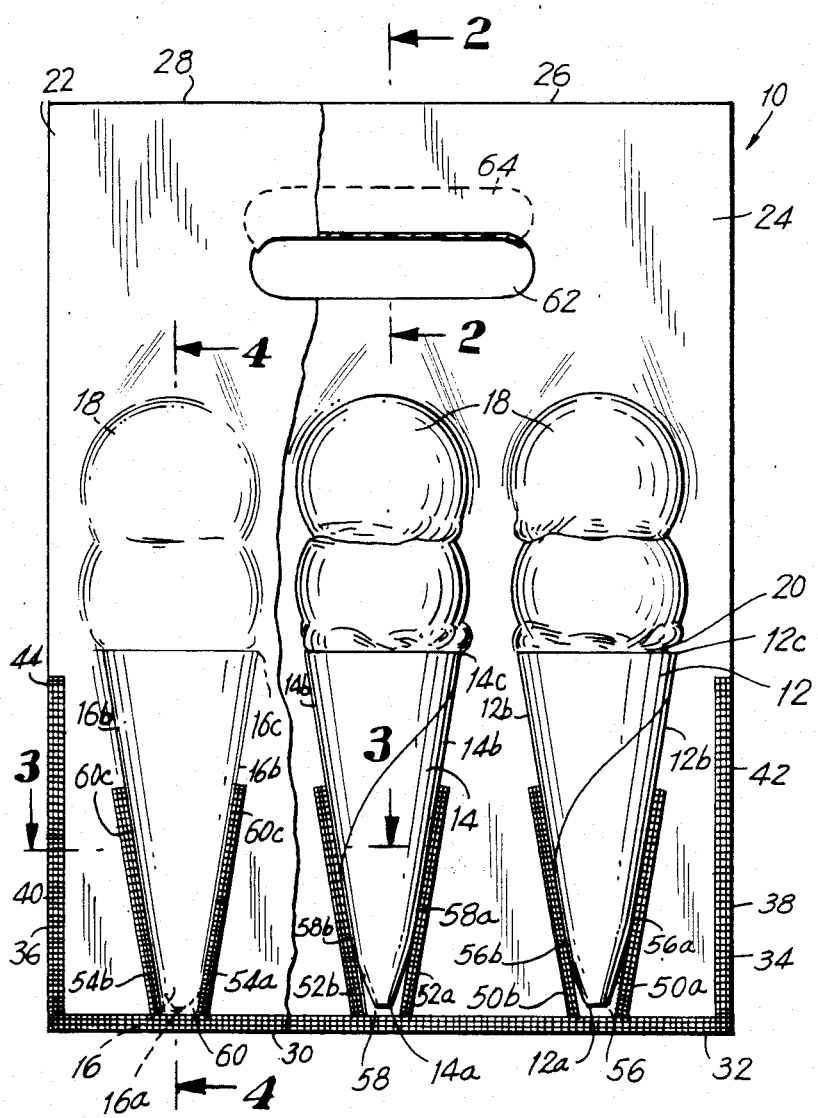
FIG. 1 is a partially broken away front view of a carrying bag of the present invention filled with edible cones and their associated frozen comestibles.
Figure 2:
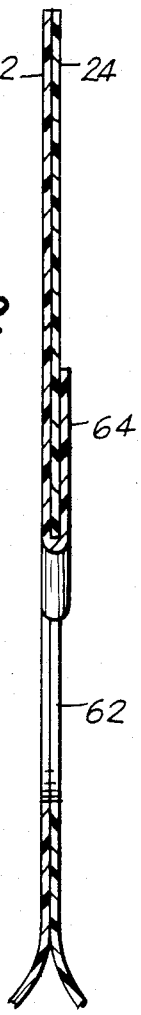
FIG. 2 is a sectional view taken substantially along line 2—2 of FIG. 1.
Figure 3:
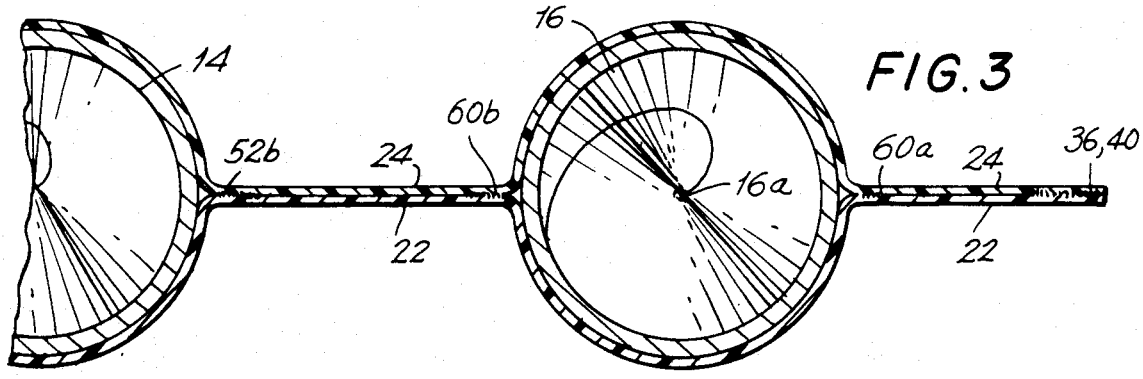
FIG. 3 is a sectional view taken substantially along line 3—3 of FIG. 1.

Referring now in detail to the drawings and more particularly to FIG. 1, the reference numeral 10 denotes a carrying bag for holding a plurality of edible cones 12, 14, 16, the cones having associated frozen comestibles 18. The associated frozen comestibles 18 are deposited on an open end 20 of each cone.

The cones 12, 14, 16 may be any edible cone item; for example, sugar cones and wafer cones and tapered edible cups may be carried in bag 10. The frozen comestibles associated with and deposited on said cones may be any appropriate frozen comestible, for example soft or hard ice cream or sherbert may be deposited on the open ends of the cones.

The carrying bag 10 is composed of two substantially planar sheets 22, 24. At least the inner surface 22*a*, 24*a* of each of said substantially planar sheets is composed of a material having a slippery surface. In a preferred embodiment each planar sheet is a thin limp polyethylene panel.

The substantially planar sheets 22, 24 are formed with top edges 26, 28; bottom edges 30, 32 which preferably are joined to one another to form a unitary bottom for the bag as hereinafter described; and side edges 34, 36, 38, 40 which are partially sealed together as hereinafter described.

The sheets 22, 24 are of substantially the same size and shape and sheet 22 is juxtaposed directly behind and in registration with sheet 24.

As heretofore mentioned in the preferred form of the invention the bottom edges 30, 32 of the sheets 22 and 24 are joined to one another to form a unitary bottom for the bag. In a preferred embodiment, the sheets 22 and 24 constitute a single elongated planar web which is folded along the transverse center thereof and hence said central fold provides the means for joining together bottom edges 30 and 32.

Likewise in the preferred form of the invention, lower portions of the two side edges 34, 36, 38, 40 of each planar sheet preferably are joined to one another to form two unitary side edges for the bag. As an example, the joined portions 42, 44 of the side edges are so joined by applying pressure and heat. The joined portions 42, 44 extend upwardly from the bottom edges 30, 32 to points remote from the top edges 26, 28. The non-joined portions of the side edges define two upper panel segments 46, 48 of the carrying bag 10.

Pursuant to the instant invention, sheets 22 and 24 are joined to one another between the side edges thereof along a plurality of pairs of spaced zones 50*a*, 50*b*, 52*a*, 52*b*, 54*a*, 54*b*. Thus, as an example, said sheets are joined along said pairs of spaced zones by the linear application of heat and pressure. The pairs of spaced zones converge diagonally downwardly toward one another to thereby define a plurality of downwardly tapering quasi-conical pockets 56, 58, 60. As shown in FIG. 1, each zone may comprise a single joined seam or alternatively as shown in FIG. 7 each zone may comprise a plurality of spaced autogeneously welded areas 50*c*, 50*d*, 50*e*, 50*f*, 52*c*, 52*d*, 52*e*, 52*f*, 54*c*, 54*d*, 54*e*, 54*f*.

Pockets 56, 58, 60 are shaped and dimensioned to receive edible cones 12, 14, 16. The flexibility of the pockets inhibits breakage of the cones upon their introduction into said pockets. The pockets are formed to be small enough to securely hold and support said cones.

The cones 12, 14, 16 with their associated frozen comestibles 18 when received in pockets 56, 58, 60 have their apices 12*a*, 14*a*, 16*a* pointing downwardly, their conical side walls 12*b*, 14*b*, 16*b* supported by the slanty surfaces 56*a*, 58*a*, 60*a* of the pockets and their upper ends 12*c*, 14*c*, 16*c* positioned approximately at the upper level 62 of the joined side portions of sheets 22 and 24 which are at approximately the back of the wider mouths of the pockets. The frozen comestibles 18 deposited on the cones are located slightly above the tops of the pairs of zones which define the pockets and are in loose contact with the slippery inner surfaces of the upper panel segments 46, 48.

The carrying bag 10 is formed with a handle means which in a preferred embodiment consists of an elongated slot 62 formed on one planar sheet 22 and an elongated tab segment 64 formed on the other planar sheet 24. Elongated tab 64 is shaped and dimensioned so that when folded it can be inserted through elongated slot 62. Tab 64 and slot 62 cooperate to form a well known convenient and secure handle means. The slot and associated tab are adjacent to and spaced away from the top edges of planar sheets 26 and 28, on the portions of same comprising upper panel segments 46 and 48, and thus are above the center of gravity of the cone-filled carrying bag 10 to thereby insure that said carrying bag when filled is in stable equilibrium.

As shown in FIG. 6, carrying bag 10 may be constituted of a foamed plastic insulating material having the aforementioned slippery inner surfaces to lengthen the time the frozen comestible can be carried without deterioration.

Carrying bag 10 may contain any appropriate printing on the outer surfaces thereof. For example, identifying indicia may be included thereon showing the store in which the cones were purchased.

Carrying bag 10 provides a method for securely carrying a plurality of edible cones each cone having a frozen comestible deposited on the open end thereof. The person dispensing the cones and associated frozen comestibles deposits the frozen comestibles on the open ends of the cones and then places the filled cones in the plurality of pockets of carrying bag 10. As heretofore described, when in the pockets of said bag, the apex of each cone points downwardly, the conical side walls of each cone are supported on the slanty surfaces of each pocket and the upper end of each cone is positioned approximately at the upper level of the joined side portions of the planar sheets. The frozen comestible is positioned above the tops of the spaced zones and in loose contact with the slippery inner surfaces of the upper panel segments. The sales person fills as many cones as desired with a frozen comestible and places the filled cones in the pockets of the bag. The bag 10, shown in the drawings has three pockets in which cones may be placed, however said three pockets are shown merely by way of example, more may be present.

After the frozen filled cones are placed within the pockets of bag 10, a user may safely and securely transport said filled cones from place to place by grasping and holding the filled bag by its handle means. The filled carrying bag when so held is in stable equilibrium and hence said filled bag will securely retain the cones and comestibles contained therein while the user walks carrying same.

The comestibles carried in bag 10 are protected from dirt and dust by said bag which is formed to be sufficiently high enough to so protect said edibles. Additionally, the pockets formed in the bag provide secure receptacles for the filled cones which minimize the possibility of said filled cones tipping and hence disgorging their frozen contents.

In essence, carrying bag 10 provides a hammock in which frozen filled cones can be securely supported while being transported from place to place. The slippery inner surfaces of bag 10 insure that the frozen comestibles will not stick to the bag even if they come in contact with same.

It will be understood that each of the elements described above, or two or more together, may also find a useful application in other types of constructions differing from the types described above.

While the invention has been illustrated and described as embodied in a carrying bag for securely holding edible cones having a frozen comestible deposited on the open end thereof, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A carrying bag for holding a plurality of edible cones on upper open end regions of which frozen comestibles are deposited, comprising:

(A) a pair of substantially planar, flexible, limp sheets of substantially the same size and shape, said sheets having lower portions in juxtaposed registration with each other, and upper portions movable relative to each other between a cone-filling position in which the upper portions are spaced apart from each other, and a cone-carrying position in which the upper portions are in juxtaposed registration with each other, (i) said upper portions having smooth, slippery surfaces which face each other in the cone-carrying position, and opposite pairs of unjoined side edge regions, (ii) said lower portions having a closed bottom edge region, and opposite pairs of joined side edge regions colinear with the unjoined side edge regions in the cone-carrying position;

(B) means for joining the lower portions to each other between the opposite pairs of joined side edge regions at a plurality of pairs of spaced zones, each pair of spaced zones converging toward each other in a direction generally downwardly toward the bottom edge region, and for forming generally conical pockets in which respective edible cones are supportably received in upright condition between the joined side edge regions with the respective frozen comestibles supported above the lower portions and between the smooth, slippery surfaces of the upper portions in the cone-carrying position; and (C) handle means on the upper portions above the center of gravity of the bag when the pockets are filled with cones, for carrying the cones in a stable equilibrium, said handle means including a pair of handle portions on the upper portions and interconnected with each other in the cone-carrying position to join the upper portions to each other only at the interconnected handle portions and to position the smooth, slippery surfaces of the upper portions into conforming contact with the frozen comestibles therebetween and to prevent the frozen comestibles from escaping through the unjoined side edge regions during carrying.

2. The carrying bag as recited in claim 1, wherein the sheets have a generally rectangular shape, and wherein the lower portions have linear side edge regions which are heat- and pressure-sealed to each other.

3. The carrying bag as recited in claim 2, wherein the lower portions have linear bottom edge regions which are heat- and pressure-sealed to each other.

4. The carrying bag as recited in claim 1, wherein each sheet is composed of polyethylene.

5. The carrying bag as recited in claim 1, wherein each sheet is composed of a foamed plastic material.

6. The carrying bag as recited in claim 1, wherein each zone constitutes a single joined linear seam.

7. The carrying bag as recited in claim 1, wherein each zone constitutes a plurality of joined areas spaced apart from one another along said converging direction.

8. The carrying bag as recited in claim 1, wherein one of the handle portions is an elongated slot formed on one of the sheets, and the other of the handle portions is an elongated tab on the other of the sheets, and wherein the tab is foldable and inserted into the slot in the cone-carrying position.

9. A carrying bag for supportably holding in upright condition a plurality of edible cones on upper open end regions of which frozen comestibles are deposited, comprising:

(A) a pair of substantially planar, flexible, limp sheets of substantially the same size and generally rectangular shape, said sheets having generally rectangular lower portions in juxtaposed registration with each other, and generally rectangular upper portions movable relative to each other between a cone-filling position in which the upper portions are spaced apart from each other, and a cone-carrying position in which the upper portions are in juxtaposed registration with each other, (i) said upper portions having smooth, slippery surfaces which face each other in the cone-carrying position, and opposite pairs of unjoined side edge regions, (ii) said lower portions having linear bottom edge regions in registration with and joined to each other, and opposite pairs of joined linear side edge regions colinear with the unjoined side edge regions in the cone-carrying position;

(B) means for joining the lower portions to each other between the opposite pairs of joined side edge regions at a plurality of pairs of spaced zones, each pair of spaced zones converging toward each other in a direction generally downwardly toward the joined bottom edge regions, and for forming generally conical pockets in which respective edible cones in upright condition are supportably received between the joined side edge regions with the respective frozen comestibles supported above the lower portions and between the smooth, slippery surfaces of the upper portions in the cone-carrying position; and (C) handle means on the upper portions above the center of gravity of the bag when the pockets are filled with cones, for carrying the cones in a stable equilibrium, said handle means including a pair of handle portions on the upper portions and interconnected with each other in the cone-carrying position to join the upper portions to each other only at the interconnected handle portions and to position the smooth, slippery surfaces of the upper portions into conforming contact with the frozen comestibles therebetween and to prevent the frozen comestibles from escaping through the unjoined side edge regions during carrying.

* * * * *